US008861012B2

(12) United States Patent
Matsushita

(10) Patent No.: US 8,861,012 B2
(45) Date of Patent: Oct. 14, 2014

(54) CONTROL APPARATUS, IMAGE FORMING SYSTEM, AND NON-TRANSITORY COMPUTER-READABLE MEDIUM

(71) Applicant: Fuji Xerox Co., Ltd., Tokyo (JP)

(72) Inventor: Issei Matsushita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/025,149

(22) Filed: Sep. 12, 2013

(65) Prior Publication Data

US 2014/0147156 A1 May 29, 2014

(30) Foreign Application Priority Data

Nov. 28, 2012 (JP) ..... 2012-260395

(51) Int. Cl.
*G03G 15/00* (2006.01)

(52) U.S. Cl.
CPC ..... *G03G 15/5066* (2013.01)
USPC ..... 358/1.16; 358/1.13; 358/1.15

(58) Field of Classification Search
None
See application file for complete search history.

(56) References Cited

U.S. PATENT DOCUMENTS

| | | | | |
|---|---|---|---|---|
| 2005/0089013 | A1 | 4/2005 | Okagawa et al. | |
| 2006/0262340 | A1 | 11/2006 | Lee | |
| 2006/0279782 | A1* | 12/2006 | Kim | 358/1.16 |
| 2007/0008580 | A1 | 1/2007 | Tanaka | |
| 2007/0223034 | A1 | 9/2007 | Matsumoto et al. | |
| 2011/0125781 | A1* | 5/2011 | Kasahara | 707/769 |
| 2012/0250053 | A1* | 10/2012 | Mitsubori et al. | 358/1.13 |
| 2013/0003102 | A1 | 1/2013 | Edgar et al. | |
| 2013/0016389 | A1* | 1/2013 | Robinson | 358/1.15 |
| 2013/0083349 | A1* | 4/2013 | Wu et al. | 358/1.15 |
| 2014/0022590 | A1* | 1/2014 | Matsuda et al. | 358/1.15 |

FOREIGN PATENT DOCUMENTS

| | | | |
|---|---|---|---|
| CN | 1867030 | A | 11/2006 |
| CN | 102368206 | A | 3/2012 |
| CN | 102402494 | A | 4/2012 |
| JP | 59-083429 | A | 5/1984 |
| JP | 05-236007 | A | 9/1993 |
| JP | 06-067925 | A | 3/1994 |
| JP | 06-135013 | A | 5/1994 |

(Continued)

OTHER PUBLICATIONS

Chinese Office Action issued in Chinese Patent Application No. 201310553336.6 issued on Jun. 5, 2014.

*Primary Examiner* — Kimberly A Williams
(74) *Attorney, Agent, or Firm* — Sughrue Mion, PLLC

(57) ABSTRACT

A control apparatus includes an output unit, a transmission unit, an output-history generating unit, a transmission-history generating unit, a checking unit, and a determination-information generating unit. The output unit acquires image formation information items, and performs output processes of outputting the information items to a storage unit. The transmission unit acquires the information items, and performs transmission processes of transmitting the information items to the image forming unit. The output-history generating unit generates output histories in which an order in which unit processes constituting the output processes have been performed is recorded. The transmission-history generating unit generates transmission histories in which an order in which unit processes constituting the transmission processes have been performed is recorded. The checking unit checks whether the orders match. The determination-information generating unit generates a determination information item to be used in determination of a unit process.

9 Claims, 13 Drawing Sheets

(56) References Cited

FOREIGN PATENT DOCUMENTS

| | | | | |
|---|---|---|---|---|
| JP | 07-334334 | A | | 12/1995 |
| JP | 2001-167094 | A | | 6/2001 |
| JP | 2005-130366 | A | | 5/2005 |
| JP | 2005-190193 | A | | 7/2005 |
| JP | 2005-251050 | A | | 9/2005 |
| JP | 2007-018306 | A | | 1/2007 |
| JP | 2007-259127 | A | | 10/2007 |
| JP | 2008-119966 | A | | 5/2008 |
| JP | 2008-532128 | A | | 8/2008 |
| JP | 2008-276359 | A | | 11/2008 |
| JP | 2010072908 | A | * | 4/2010 |
| JP | 2011-116135 | A | | 6/2011 |
| JP | 2011-170451 | A | | 9/2011 |
| JP | 2011-213006 | A | | 10/2011 |
| WO | 2006/089743 | A2 | | 8/2006 |
| WO | 2011/114093 | A1 | | 9/2011 |

* cited by examiner

FIG. 7A

111

| (LINE) | | |
|---|---|---|
| 1 | JOB A | START |
| 2 | JOB A | END |
| 3 | JOB B | START |
| 4 | JOB B | END |
| 5 | JOB C | START |
| 6 | JOB C | END |
| 7 | JOB D | START |
| 8 | JOB D | END |
| 9 | JOB E | START |
| 10 | JOB E | END |
| 11 | JOB F | START |
| 12 | JOB F | END |
| 13 | JOB E | CANCEL |
| ⋮ | ⋮ | |

FIG. 7B

131

| (LINE) | | |
|---|---|---|
| 1 | JOB A | START |
| 2 | JOB A | END |
| 3 | JOB C | START |
| 4 | JOB C | END |
| 5 | JOB B | START |
| 6 | JOB B | END |
| 7 | JOB D | START |
| 8 | JOB D | END |
| 9 | JOB F | START |
| 10 | JOB F | END |
| ⋮ | ⋮ | |

CONTROL APPARATUS, IMAGE FORMING SYSTEM, AND NON-TRANSITORY COMPUTER-READABLE MEDIUM

CROSS-REFERENCE TO RELATED APPLICATIONS

This application is based on and claims priority under 35 USC 119 from Japanese Patent Application No. 2012-260395 filed Nov. 28, 2012.

BACKGROUND

1. Technical Field

The present invention relates to a control apparatus, an image forming system, and a non-transitory computer-readable medium.

2. Summary

According to an aspect of the invention, there is provided a control apparatus including an output unit, a transmission unit, an output-history generating unit, a transmission-history generating unit, a checking unit, and a determination-information generating unit. The output unit acquires image formation information items which are to be used in image formation by an image forming unit which forms images, and performs output processes of outputting the image formation information items in order to cause a storage unit that temporarily stores the image formation information items to store the image formation information items. The transmission unit acquires the image formation information items from the storage unit, and performs transmission processes of transmitting the image formation information items to the image forming unit. The output-history generating unit generates output histories in which an order in which unit processes constituting the output processes have been performed is recorded. The transmission-history generating unit generates transmission histories in which an order in which unit processes constituting the transmission processes have been performed is recorded. The checking unit checks whether or not the order in which the unit processes have been performed, which is recorded in the output histories, and the order in which the unit processes have been performed, which is recorded in the transmission histories, match. The determination-information generating unit generates a determination information item which is to be used in determination of a unit process, among the unit processes, that has been checked by the checking unit in the output histories and a unit process, among the unit processes, that has been checked by the checking unit in the transmission histories.

BRIEF DESCRIPTION OF THE DRAWINGS

An exemplary embodiment of the present invention will be described in detail based on the following figures, wherein:

FIGS. 7A and 7B are system flow diagrams illustrating the procedure of transmission processes performed by the storage unit and the print control unit;

DETAILED DESCRIPTION

Hereinafter, an exemplary embodiment of the present invention will be described in detail with reference to the accompanying drawings.

System Configuration

Figure 1:
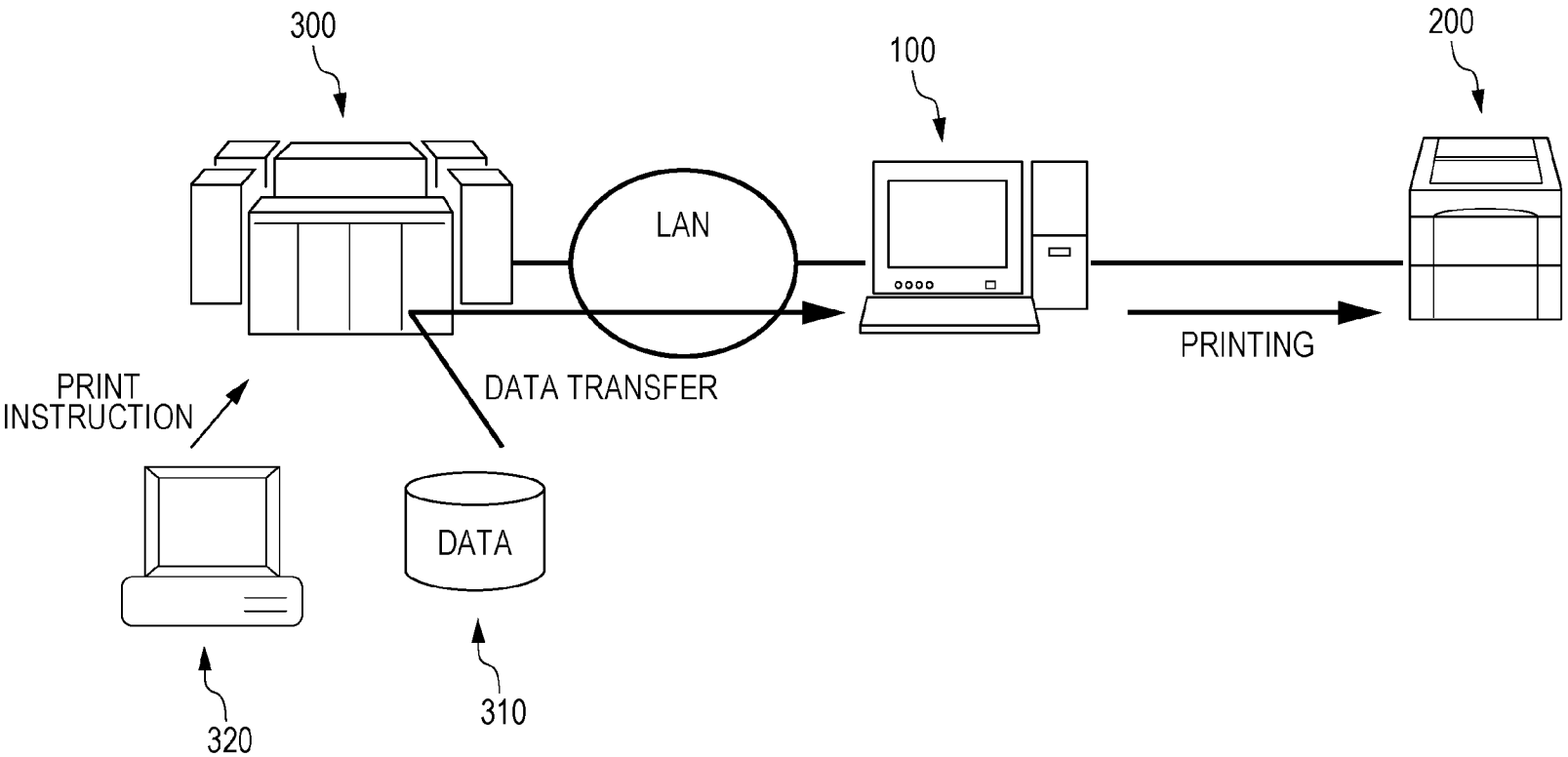
FIG. 1 is a diagram illustrating an example of a configuration of an image forming system according to the present exemplary embodiment.

FIG. 1 is a diagram illustrating an example of a configuration of an image forming system according to the present exemplary embodiment.

The image forming system illustrated in FIG. 1 includes a print server 100 and an image forming apparatus 200. The print server 100 manages print jobs that are processes based on print instructions (output instructions). The image forming apparatus 200 performs print processes (image forming processes) under control of the print server 100. The print server 100 and the image forming apparatus 200 are connected, directly or via a network or the like, to each other so as to transmit/receive data to/from each other. Furthermore, the print server 100 is connected to a host server 300 via a local area network (LAN).

The print server 100, which is provided as an example of a control apparatus, is realized using, for example, a personal computer having a network function. The print server 100 receives print instructions and print data (output data) from the host server 300, and stores (spools) the print data. Then, the print server 100 transmits the stored print data to the image forming apparatus 200, and causes the image forming apparatus 200 to perform print processes. Moreover, the print server 100 according to the present exemplary embodiment checks whether or not print control is performed for the image forming apparatus 200 in a correct order based on the print instructions acquired from the host server 300. A specific functional configuration of the print server 100 will be described below.

The image forming apparatus 200, which is provided as an example of an image forming unit, acquires print data from the print server 100, and forms (prints) and outputs images on recording media, such as sheets of paper, using an image formation material on the basis of the acquired print data. A mechanism for forming an image on a recording medium is not particularly limited in the present exemplary embodiment, and existing various types of schemes, such as a so-called electrophotographic system and an inkjet system, may be used.

The host server 300 is realized using, for example, a computer having a network function, and includes a storage device 310 that holds print data. The host server 300 accepts print instructions, reads print targets (print data) specified by the print instructions from the storage device 310, and transmits the print targets to the print server 100. The print instructions are input from, for example, a terminal apparatus 320 that is connected to the host server 300. The terminal apparatus 320 is realized using, for example, a personal computer having an input device such as a keyboard.

Functional Configuration of Print Server

Figure 2:
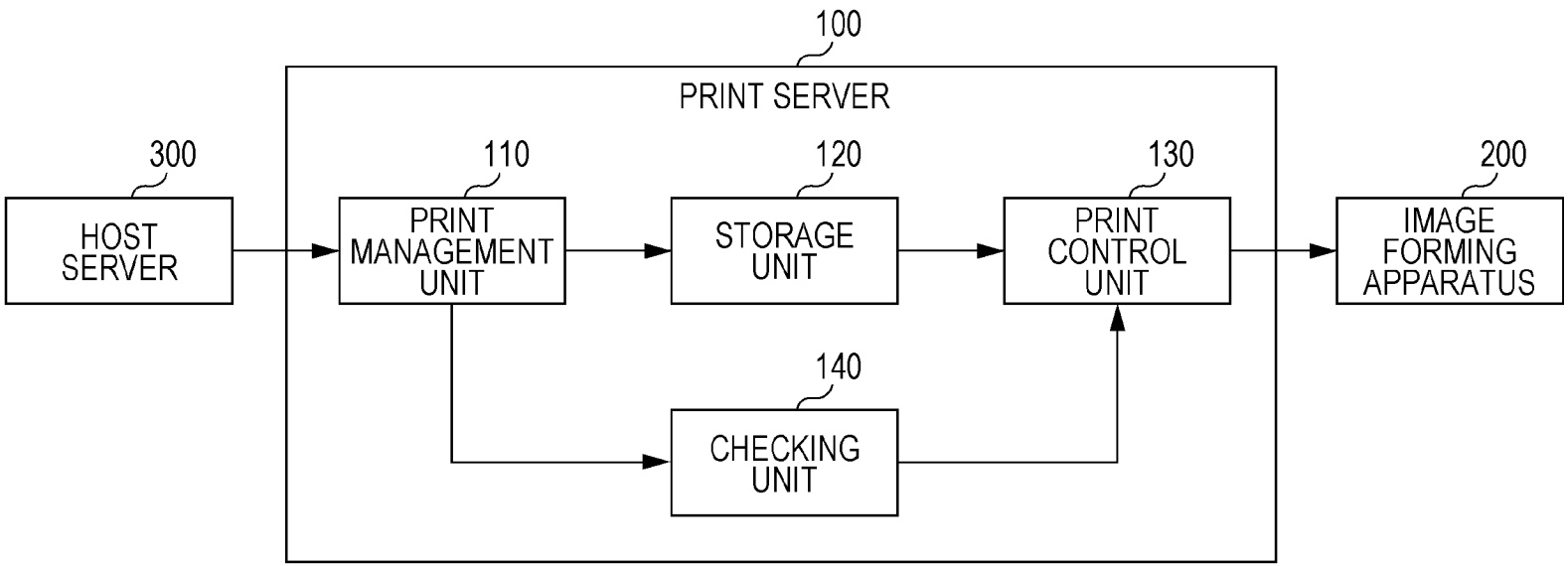
FIG. 2 is a diagram illustrating an example of a functional configuration of a print server according to the present exemplary embodiment.

FIG. 2 is a diagram illustrating an example of a functional configuration of the print server 100.

As illustrated in FIG. 2, the print server 100 according to the present exemplary embodiment includes a print management unit 110, a storage unit 120, and a print control unit 130. The print management unit 110 acquires print data, and performs data processing. The storage unit 120 stores the print data. The print control unit 130 controls the image forming apparatus 200. Furthermore, the print server 100 according to the present exemplary embodiment further includes a checking unit that checks a print order in which the print data have been printed.

The print management unit 110, which is provided as an example of an output unit and an output-history generating unit, acquires print instructions and print data from the host server 300, converts the acquired print data into intermediate data, and causes the storage unit 120 to store the intermediate data. The print data received from the host server 300 are written in a page description language (PDL). Thus, the print management unit 110 analyzes the received print data, and converts the received print data into intermediate data that are not so much dependent on the type of apparatus or a data processing environment. Then, the print management unit 110 transmits the generated intermediate data to the storage unit 120. Moreover, the print management unit 110 in the present exemplary embodiment generates history information items (hereinafter, referred to as an "output-order list"). In the output-order list, an order in which processes (hereinafter, referred to as "output processes") of outputting the print data (the intermediate data) in order to store the print data in the storage unit 120 have been performed is recorded.

The storage unit 120, which is provided as a storage unit, temporarily stores the print data that have been converted into the intermediate data by the print management unit 110. Because a processing speed of the image forming apparatus 200 that physically forms images on recording media is lower than a data processing speed of the print server 100, the print data are stored so that the speed difference between the data processing speed of the print server 100 and the processing speed of the image forming apparatus 200 is absorbed. Accordingly, in the case where multiple print instructions are provided in a short time period, multiple print data corresponding to the print instructions may be stored in the storage unit 120. When the image forming apparatus 200 becomes capable of accepting print data, the stored print data are sequentially read and passed on to the print control unit 130.

The print control unit 130, which is provided as an example of a transmission unit and a transmission-history generating unit, is a so-called printer driver. When the image forming apparatus 200 is capable of accepting print data, the print control unit 130 acquires print data from the storage unit 120, and transmits the print data to the image forming apparatus 200. As described above, in the case where multiple print data are stored in the storage unit 120, the print control unit 130 acquires one of the stored print data on a one-by-one basis every time a print process performed by the image forming apparatus 200 finishes, and transmits the print data to the image forming apparatus 200. Furthermore, the print control unit 130 in the present exemplary embodiment generates history information items (hereinafter, referred to as a "print-order list"). In the print order list, an order in which processes (hereinafter, referred to as "transmission processes") of acquiring print data from the storage unit 120 and transmitting the print data to the image forming apparatus 200 have been performed is recorded. The print-order list is generated by, for example, a language monitor or port monitor that is in control of a transmission control function of the print control unit 130 which is a function for transmission to the image forming apparatus 200. Note that, because the print processes are performed by the image forming apparatus 200 on the basis of the print data transmitted through the transmission processes, an output order in which images are output through the print processes is the same as an order in which the transmission processes have been performed and which is recorded in the print-order list.

Here, among storage units 120 used in existing image forming systems, there is a storage unit 120 having a certain specification, and, in the certain specification, in the case where multiple print data are stored, an order in which the print data are read from the storage unit 120 is not guaranteed. In other words, an order in which the multiple print data are stored and the order in which the multiple print data are read may be different from each other. In such a system, for example, even in the case where print instructions for print jobs A, B, and C are provided in this order, the order is changed when print data are read from the storage unit 120, and, for example, the print jobs A, C, and B may be executed by an image forming apparatus 200 in this order.

In contrast, in the case where multiple print jobs are executed, print results may be requested to be output in an order in which print instructions have been provided. In this case, in the image forming system having the storage unit 120 that has the above-mentioned specification, the order of the output print results does not necessarily match the order of the print instructions. Accordingly, the order of the output print results needs to be checked, for example, manually. In the preset exemplary embodiment, as described below, the transmission processes performed by the print control unit 130 are checked by the checking unit 140.

The checking unit 140, which is provided as a checking unit and a determination-information generating unit, compares the output-order list, which has been generated by the print management unit 110, with the print-order list, which has been generated by the print control unit 130, thereby checking whether the order in which the output processes have been performed and the order in which the transmission processes have been performed are different from each other. Then, when the order in which the output processes have been performed and the order in which the transmission processes have been performed are different from each other, the checking unit 140 performs an error process. The details of processes performed by the checking unit 140 will be described below.

It is assumed that there is a case in which, after print data has been stored in the storage unit 120, an instruction (a cancellation instruction) to cancel execution of a print job before the stored print data is read. In this case, the print data that is a target of the cancellation instruction is not read from the storage unit 120, and the print job based on the print data is not executed by the image forming apparatus 200. Then, no information item concerning the transmission process of transmitting the print data that is the target of the cancellation instruction is recorded in the print-order list. Accordingly, the order in which the output processes have been performed and which is recorded in the output-order list and the order in which the transmission processes have been performed and which is recorded in the print-order list do not match. However, a process (a cancellation process) based on the valid cancellation instruction is performed, and, consequently, mismatch between the output-order list and the print-order list occurs. Thus, no error process needs to be performed.

For this reason, when the print management unit 110 has received a cancellation instruction from the host server 300, the checking unit 140 acquires, from the print management unit 110, an information item indicating that this cancellation instruction has been provided, and holds the information item. Then, when the output-order list and the print-order list are compared with each other and mismatch therebetween is detected, the checking unit 140 determines, on the basis of the information item concerning the cancellation instruction, whether or not an error process is to be performed. Note that the information item concerning the cancellation instruction which is acquired by the checking unit 140 may be a certain notification information item that is used by the print management unit 110 to notify the checking unit 140 that the cancellation instruction has been provided, or may be the cancellation instruction itself. Moreover, the checking unit 140 may be notified, by recording the fact that the cancellation instruction has been provided in the output-order list, of the fact. In the present exemplary embodiment, a case where the information item concerning the cancellation instruction is recorded in the output-order list will be described as an example.

Example of Hardware Configuration

Figure 3:
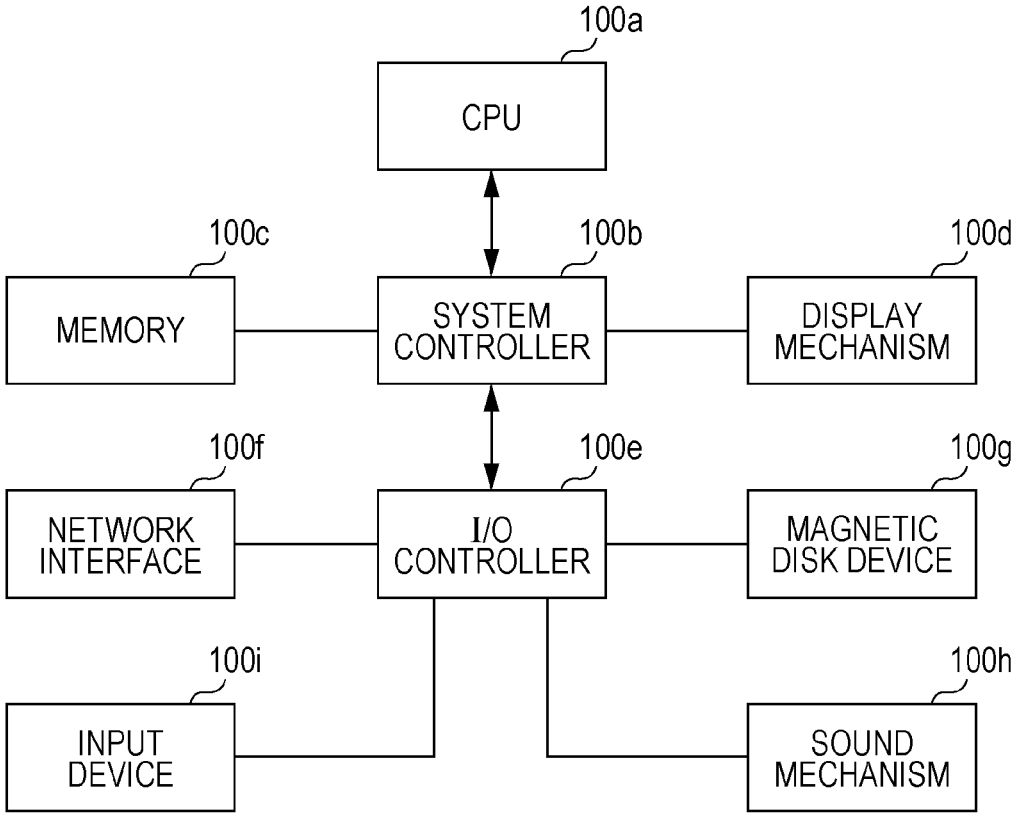
FIG. 3 is a diagram illustrating an example of a hardware configuration of the print server.

FIG. 3 is a diagram illustrating an example of a hardware configuration of the print server 100.

A computer illustrated in FIG. 3 includes a central processing unit (CPU) 100*a* that is a computing unit, and a memory 100*c* that is a main memory. Furthermore, the computer further includes a magnetic disk device (a hard disk drive (HDD)) 100*g*, a network interface 100*f*, a display mechanism 100*d*, a sound mechanism 100*h*, an input device 100*i* such as a keyboard or mouse, and so forth as external devices.

In the example of the configuration illustrated in FIG. 3, the memory 100*c* and the display mechanism 100*d* are connected to the CPU 100*a* via a system controller 100*b*. Moreover, the network interface 100*f*, the magnetic disk device 100*g*, the sound mechanism 100*h*, and the input device 100*i* are connected to the system controller 100*b* via an I/O controller 100*e*. The individual elements are connected to each other via various types of buses, such as a system bus and an input/output bus.

Note that FIG. 3 only illustrates an example of a hardware configuration of a computer to which the present exemplary embodiment is applied. The present exemplary embodiment is broadly applicable to a system that manages print jobs which are processes based on print instructions (output instructions), and realization of the present exemplary embodiment is not limited to realization using the configuration illustrated in FIG. 3.

In the computer illustrated in FIG. 3, a program for realizing the individual functions of the print server 100 is stored in the magnetic disk device 100*g*. This program is loaded in the memory 100*c*, and processes based on the program are performed by the CPU 100*a*, whereby the various types of functions are realized.

More specifically, the individual processes in the print management unit 110 are performed by the CPU 100*a* in accordance with a program that is prepared as, for example, an application program. Note that reception of print instructions and print data from the host server 300 is performed via, for example, the network interface 100*f*. Additionally, in the case of conversion of print data, the memory 100*c* is used as a working memory. Moreover, the output-order list generated by the print management unit 110 is stored in a memory such as the memory 100*c* or the magnetic disk device 100*g*.

The storage unit 120 is realized by using a memory, such as the memory 100*c* or the magnetic disk device 100*g*, as a unit that holds print data under control of the CPU 100*a* which executes a program module that is prepared as, for example, a portion of the function of an operating system (OS).

The individual processes in the print control unit 130 are performed by the CPU 100*a* in accordance with a program module that is prepared as, for example, a portion of the function of the OS. The print-order list generated by the print control unit 130 is stored in a memory such as the memory 100*c* or the magnetic disk device 100*g*.

The individual processes in the checking unit 140 are performed by the CPU 100*a* in accordance with a program that is prepared as, for example, an application program. In a case of notifying an operator of the print server 100 that an error has occurred, for example, the CPU 100*a* performs control so that the checking unit 140 performs, as an error process, a process of displaying an error message using the display mechanism 100*d* or a process of outputting a warning sound using the sound mechanism 100*h*.

Note that a program which causes a computer to realize the functions of the individual components in the present exemplary embodiment may be, for example, not only supplied by a communication unit, but also stored in a recording medium, such as a compact disc read only memory (CD-ROM), and supplied.

Operation of Print Management Unit

Figure 4:
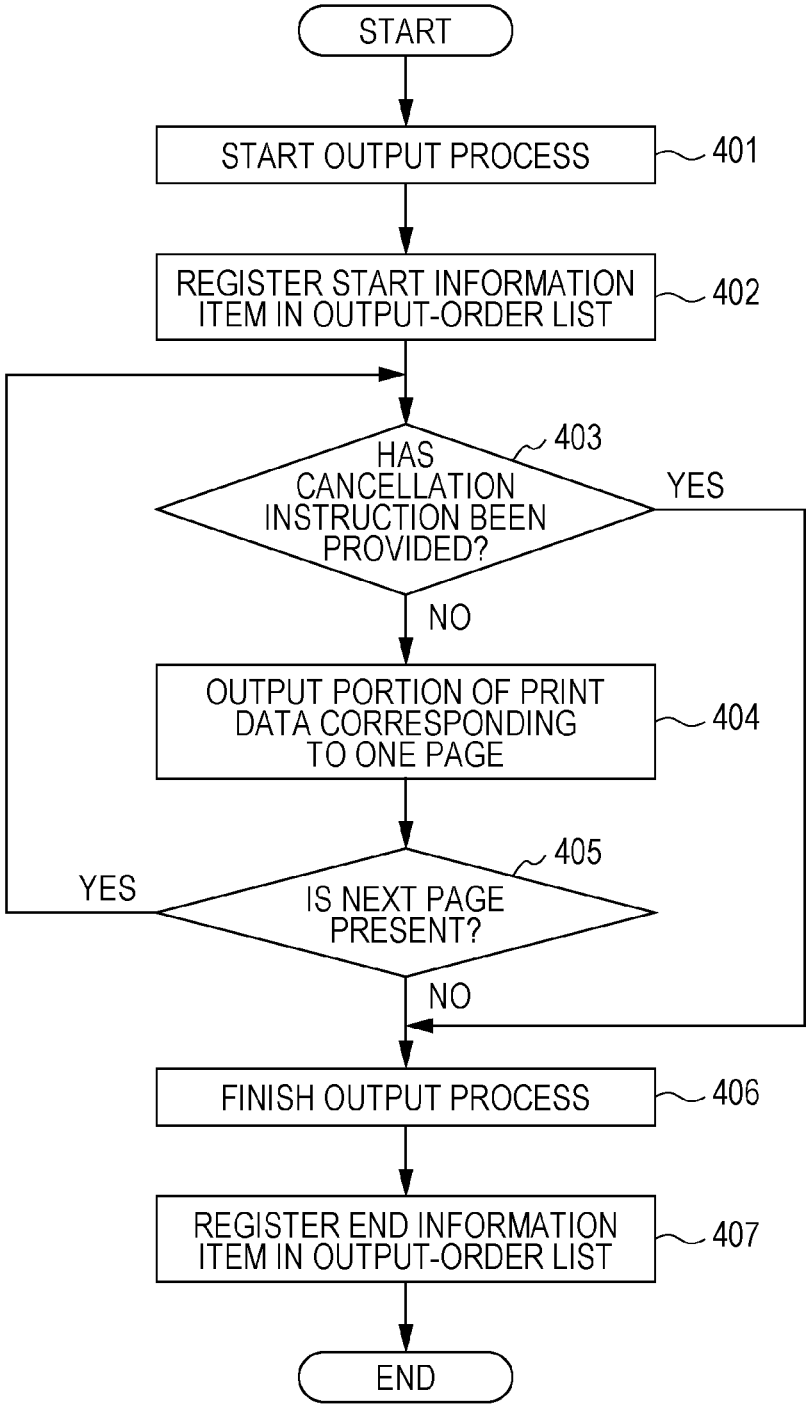
FIG. 4 is a flowchart illustrating the procedure of an output process performed by a print management unit.

FIG. 4 is a flowchart illustrating the procedure of an output process performed by the print management unit 110.

When the print management unit 110 starts an output process for a print job (hereinafter, referred to as a "target (current) job") that is a process target (step 401), the print management unit 110 registers, in the output-order list, a history information item (a start information item) indicating that the output process for the target job has started (step 402). More specifically, for example, the print management unit 110 writes the start information item in a data region of the output-order list held by the memory 100*c* illustrated in FIG. 3. Start information items are sequentially written in the output-order list in such a manner that the output-order list is filled from the top thereof. The form of each of the start information items is not particularly limited, but at least an identification information item (a job name, a job number, or the like) of the target job and an information item by which a start information item including the information item is identified as a start information item may be recorded.

Next, the print management unit 110 outputs print data (intermediate data), and stores the print data in the storage unit 120. More specifically, first, the print management unit 110 determines whether or not a cancellation instruction has been accepted (step 403). When the print management unit 110 has not accepted a cancellation instruction, the print management unit 110 outputs a portion of the print data corresponding to one page, and stores the portion of the print data corresponding to one page in the storage unit 120 (step 404). These processes are repeatedly performed until the processes are performed on all portions of the print data corresponding to all pages (step 405).

After all portions of the print data corresponding to all pages for the target job have been output (NO in step 405) or when a cancellation instruction has been accepted (YES in step 403), the print management unit 110 finishes the output process for the target job (step 406). Then, the print management unit 110 registers, in the output-order list, a history information item (an end information item) indicating that the output process for the target job has finished (step 407). As in the case of start information items, end information items are sequentially written in, for example, the data region of the output-order list held by the memory 100*c* illustrated in FIG. 3. The form of each of the end information items is not particularly limited, but at least the identification information item of the target job and an information item by which an end information item including the information item is identified as an end information item may be recorded.

Figure 5:
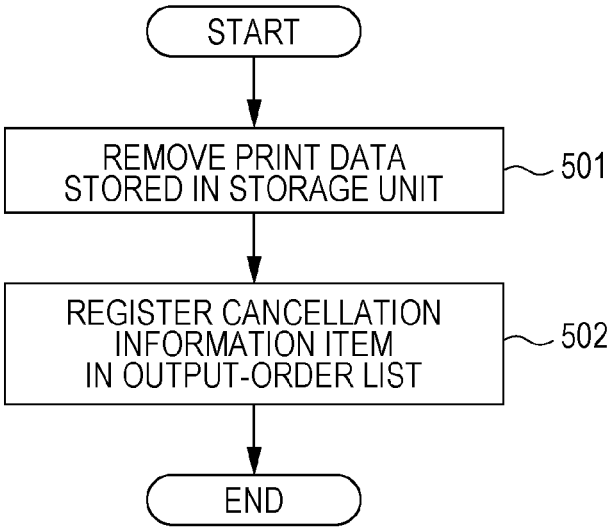
FIG. 5 is a flowchart illustrating the procedure of a process performed by the print management unit in the case where a cancellation instruction is accepted.

FIG. 5 is a flowchart illustrating the procedure of a process performed by the print management unit 110 in the case where a cancellation instruction is accepted.

In the case where the print management unit 110 has accepted a cancellation instruction in step 403 illustrated in FIG. 4, the print management unit 110 finishes the output process as illustrated in FIG. 4, and removes the print data stored in the storage unit 120 in steps 404 and 405 (step 501). Then, the print management unit 110 registers, in the output-order list, a history information item (a cancellation information item) indicating that the cancellation instruction for the target job has been provided (step 502). As in the cases of start information items and end information items, cancellation information items are sequentially written in, for example, the data region of the output-order list held by the memory 100*c* illustrated in FIG. 3. The form of each of the cancellation information items is not particularly limited, but at least the identification information item of the target job and an information item by which a cancellation information item including the information item is identified as a cancellation information item may be recorded.

Here, after the output process for the target job has finished, a cancellation instruction for the target job may be provided. In this case, because the output process has already finished, in the procedure illustrated in FIG. 4, no operation based on the cancellation instruction is performed. However, removal of the print data (step 501) and registration of a cancellation information item (step 502), which are illustrated in FIG. 5, are performed. Note that it is assumed that there is a system in which, after print data has been read from the storage unit 120 by the print control unit 130, the read print data is removed from the storage unit 120. In this system, in the case where a cancellation instruction is provided after print data has been read from the storage unit 120, the print data that is a target may be absent in the storage unit 120 even when the print management unit 110 tries to remove the print data (step 501). In this case, simply, only registration of a cancellation information item (step 502) is performed.

Operation of Print Control Unit

Figure 6:
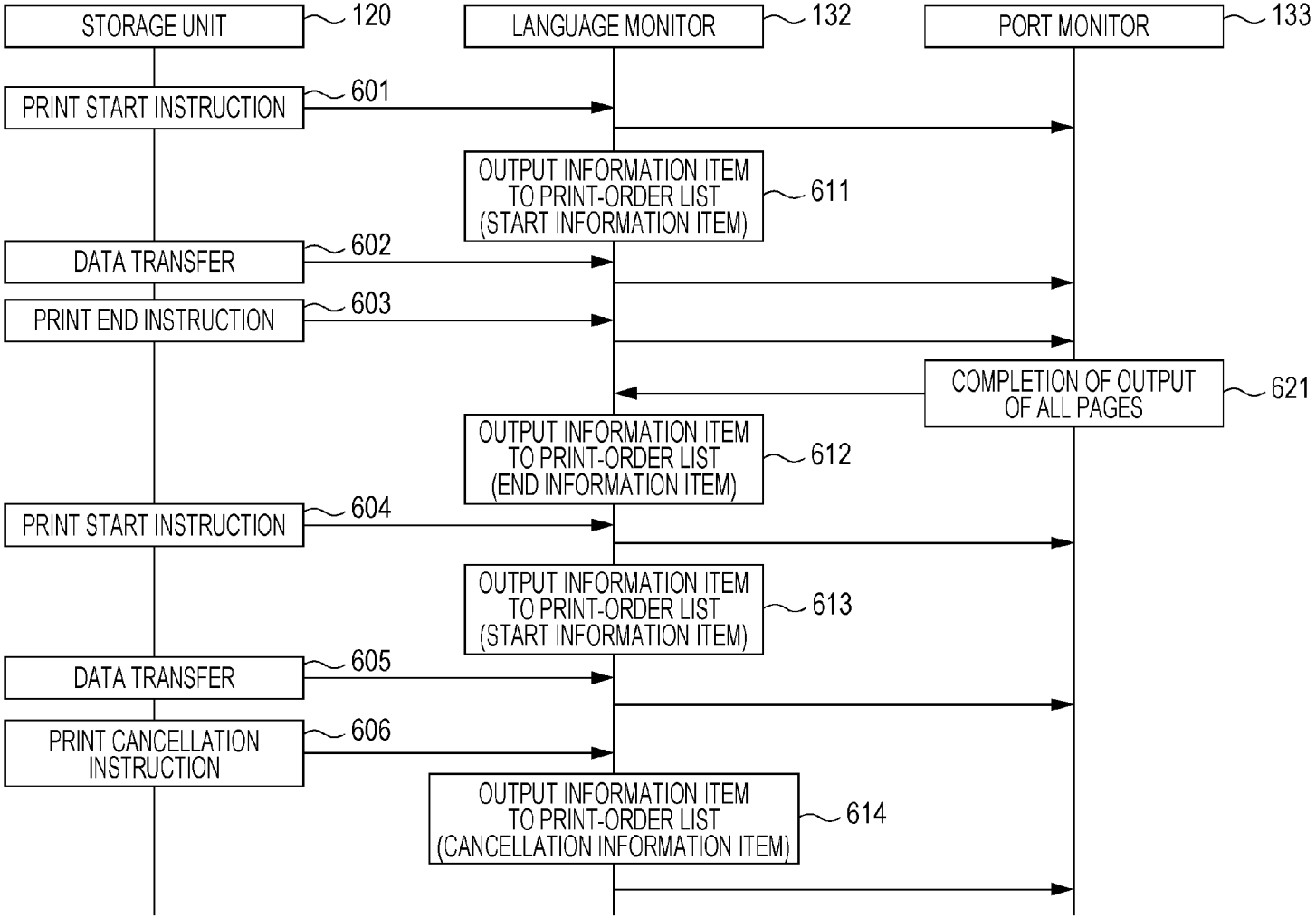
FIG. 6 is a system flow diagram illustrating the procedure of transmission processes performed by a storage unit and a print control unit.

FIG. 6 is a system flow diagram illustrating the procedure of transmission processes performed by the storage unit 120 and the print control unit 130.

In FIG. 6, an operation of the storage unit 120 that holds print data which are process targets (transmission targets) of the print control unit 130, and operations of the language monitor 132 and the port monitor 133 that are in charge of the transmission control function of the print control unit 130 are illustrated. Here, when the image forming apparatus 200 is capable of accepting print data, the storage unit 120 sequentially outputs stored print data. The language monitor 132 transmits the print data, which have been output from the storage unit 120, to the image forming apparatus 200 via the port monitor 133. Furthermore, the language monitor 132 outputs history information items indicating the progress of the transmission processes. The port monitor 133 transmits the print data, which have been received from the language monitor 132, to the image forming apparatus 200, and monitors the progress of the transmission processes.

When the image forming apparatus 200 is capable of accepting print data, first, the storage unit 120 determines a target job, and outputs a print start instruction (step 601). This print start instruction is transmitted to the image forming apparatus 200 via the language monitor 132 and the port monitor 133 of the print control unit 130. In this case, regarding determination of a target job, the storage unit 120 may have a specification in which a target job that is a target of a transmission process is determined in accordance with the order in which the print data have been stored in the storage unit 120, but the specification of the storage unit 120 is not limited thereto as described above. Note that, for example, the port monitor 133 transmits an inquiry signal to the image forming apparatus 200, and a response from the image forming apparatus 200 is transmitted to the storage unit 120, whereby whether or not the image forming apparatus 200 is capable of accepting print data is determined by the storage unit 120.

When the language monitor 132 has received the print start instruction, the language monitor 132 registers, in the print-order list, a history information item (a start information item) indicating that a transmission process for the target job has started (step 611). More specifically, for example, the language monitor 132 writes the start information item in a data region of the print-order list held by the memory 100*c* illustrated in FIG. 3. Start information items are sequentially written in the print-order list in such a manner that the print-order list is filled from the top thereof. The form of each of the start information items is not particularly limited, but at least an identification information item (a job name, a job number, or the like) of the target job and an information item by which a start information item including the information item is identified as a start information item may be recorded.

Next, the storage unit 120 sequentially read portions of the print data corresponding to pages for the target job on a page-by-page basis, and passes on the print data to the print control unit 130 (step 602). The print control unit 130 transmits, using the language monitor 132 and the port monitor 133, the acquired print data to the image forming apparatus 200.

When all of the portions of the print data for the target job have been transmitted, the storage unit 120 outputs a print end instruction for the target job (step 603). The print end instruction is transmitted to the image forming apparatus 200 via the language monitor 132 and the port monitor 133 of the print control unit 130. After that, when the port monitor 133 has received a notification indicating that output of all of the portions of the print data for the target job from the image forming apparatus 200 has been completed, the port monitor 133 transmits this notification to the language monitor 132 (step 621).

When the language monitor 132 has received the notification, which has been received from the image forming apparatus 200, from the port monitor 133, the language monitor 132 registers, in the print-order list, a history information item (an end information item) indicating that the transmission process for the target job has finished (step 612). As in the case of start information items, end information items are sequentially written in, for example, the data region of the print-order list held by the memory 100*c* illustrated in FIG. 3. The form of each of the end information items is not particularly limited, but at least the identification information item of the target job and an information item by which an end information item including the information item is identified as an end information item may be recorded.

In this manner, a transmission process for one print job finishes. After that, in the case where print data for another print job is stored in the storage unit 120, similarly, the transmission process is repeated. Referring to FIG. 6, sequentially, a transmission process for the next target job is performed (see steps 604, 605, and 613). Then, a cancellation instruction is provided while the transmission process is being performed.

As illustrated in FIG. 5, when the print management unit 110 has accepted a cancellation instruction, the print management unit 110 removes print data stored in the storage unit 120 (see step 501). When the storage unit 120 performs removal of the print data, the storage unit 120 outputs a print cancellation instruction for a print job related to the print data (step 606 in FIG. 6).

When the language monitor 132 has received the print cancellation instruction, the language monitor 132 registers, in the print-order list, a history information item (a cancellation information item) indicating that the transmission process for the target job has been cancelled (step 614). As in the cases of start information items and end information items, cancellation information items are sequentially written in, for example, the data region of the print-order list held by the memory 100*c* illustrated in FIG. 3. The form of each of the cancellation information items is not particularly limited, but at least the identification information item of the target job and an information item by which a cancellation information item including the information item is identified as a cancellation information item may be recorded.

Note that, as timings at which a print cancellation instruction is output, the following three timings are considered: before a transmission process for a print job corresponding to the print cancellation instruction starts; while the transmission process is being performed; and after the transmission process has finished. In the case where the cancellation instruction has been provided before the transmission process starts, because the transmission process is not performed, no print process is performed by the image forming apparatus 200. In the case where the cancellation instruction has been provided while the transmission process being performed, a print process is performed by the image forming apparatus 200 on portions of print data that have been subjected to the transmission process before the cancellation instruction is provided. No print process is performed by the image forming apparatus 200 on the remaining portions of the print data that have not been subjected to the transmission process when the cancellation instruction is provided. In the case where the cancellation instruction is provided after the transmission process has finished, because all of the portions of the print data for the print job have already been subjected to the transmission process, all images for the print job are output by the image forming apparatus 200. In any of the cases, a cancellation information item is output from the language monitor 132, and is registered in the print-order list.

Examples of Configurations of Output-Order List and Print-Order List

FIGS. 7A and 7B are diagrams illustrating examples of the output-order list and the print-order list.

FIG. 7A illustrates an output-order list 111. In this output-order list 111, history information items (each of which is a start information item, an end information item, or a cancellation information item) concerning output processes for six print jobs A to F are recorded. Each of the history information items includes a job name and a type of information item. For example, the history information item included in the top row is a start information item concerning the print job A, and is "job A: start". Similarly, the history information item included in the second row is an end information item concerning the print job A, and is "job A: end". Furthermore, the history information item included in the thirteenth row is a cancellation information item concerning the print job E, and is "job E: cancel".

FIG. 7B illustrates a print-order list 131. In this print-order list 131, history information items (each of which is a start information item or an end information item) concerning transmission processes for the six print jobs A to F are recorded. Each of the history information items includes a job name and a type of information item, as in the case of the history information items of the output-order list 111 illustrated in FIG. 7A.

Here, when the output-order list 111 illustrated in FIG. 7A and the print-order list 131 illustrated in FIG. 7B are compared with each other, in the output-order list 111, the third row includes a start information item concerning the job B, the fourth row includes an end information item concerning the job B, the fifth row includes a start information item concerning the job C, and the sixth row includes an end information item concerning the job C. Meanwhile, in the print-order list 131, the third row includes a start information item concerning the job C, the fourth row includes an end information item concerning the job C, the fifth row includes a start information item concerning the job B, and the sixth row includes an end information item concerning the job B. In other words, the ordinal positions of the output processes for the job B and the job C in the order in which the output processes have been performed are swapped, resulting in the ordinal position of the transmission process for the job B and the ordinal position of the transmission process for the job C in the order in which the transmission processes have been performed.

Furthermore, because a cancellation instruction for the job E has been provided, no history information item concerning the job E is present in the print-order list 131. Accordingly, in the output-order list 111, the ninth row and the tenth row include a start information item and an end information item, respectively, concerning the job E, and the eleventh row and the twelfth row include a start information item and an end information item, respectively, concerning the job F. Meanwhile, in the print-order list 131, the ninth row and the tenth row include a start information item and an end information item, respectively, concerning the job F. Note that no cancellation information item concerning the job E is recorded in the print-order list 131. The reason for this is that the print-order list 131 illustrated in FIG. 7B indicates the state of the print-order list 131 before a cancellation information item is output from the language monitor 132 of the print control unit 130.

Next, the units of files of the output-order list 111 and the print-order list 131 will be described.

Figure 8:
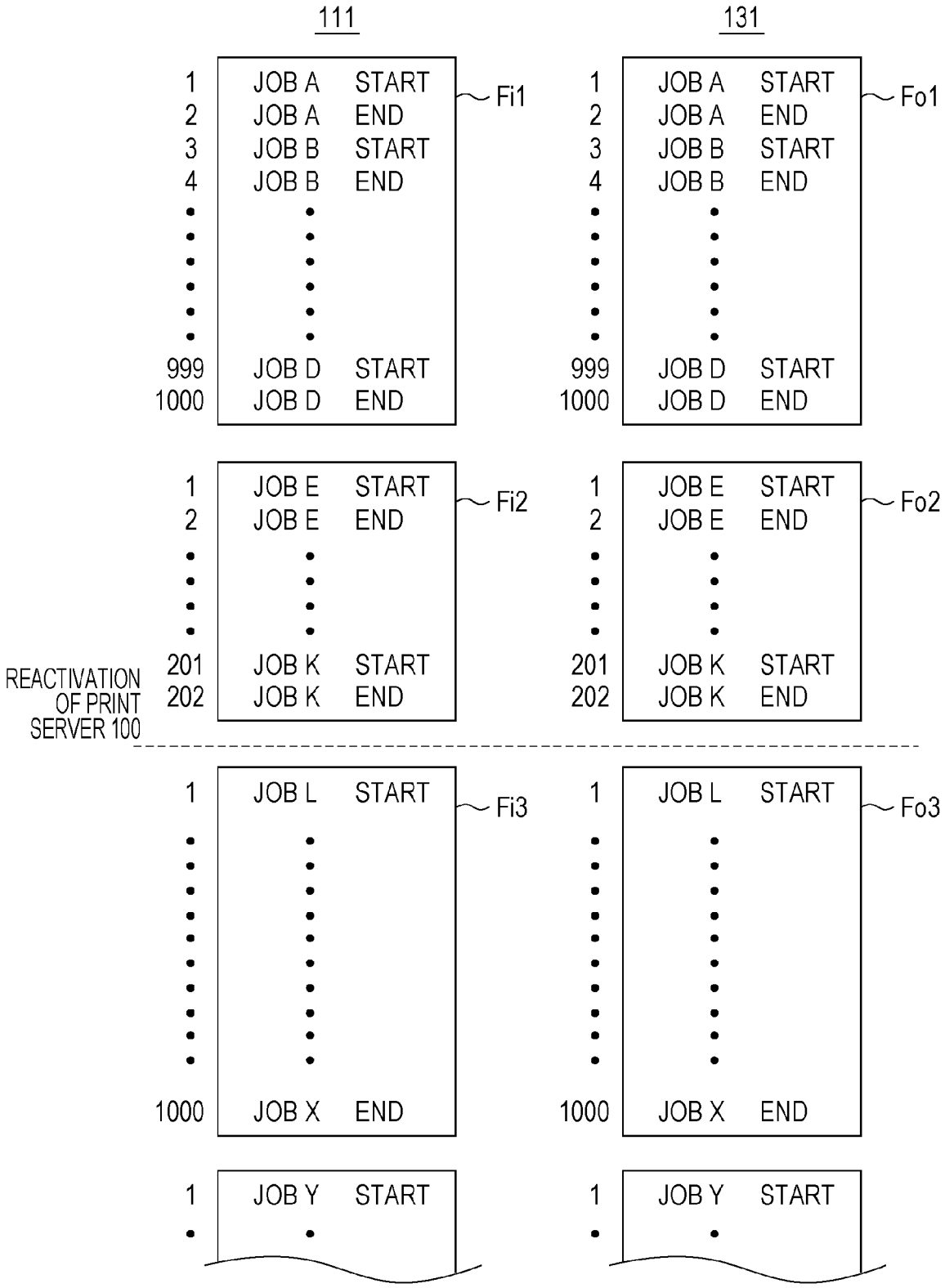
FIG. 8 is a diagram for explaining a configuration of output-order files and print-order files.

FIG. 8 is a diagram for explaining a configuration of output-order files and print-order files.

In the present exemplary embodiment, when the print server 100 is activated, a file (hereinafter, referred to as an "output-order file") in which the output-order list 111 is to be written and a file (hereinafter, referred to as a "print-order file") in which the print-order list 131 is to be written are generated. For example, as illustrated in FIG. 8, a first output-order file Fi1 and a first print-order file Fo1 are individually generated by activating the print server 100. Then, individual history information items concerning output processes and transmission processes are recorded in the first output-order file Fi1 and the first print-order file Fo1.

Furthermore, in the present exemplary embodiment, on the basis of a predetermined condition where writing of a history information item is performed in each file until the number of lines in which history information items are written reaches a certain number, writing of a history information item in the file is stopped, and writing of the next history information item in the first line of a new file is performed. In the example illustrated in FIG. 8, because the number of lines in which history information items are written reaches 1000 in each of the first output-order file Fi1 and the first print-order file Fo1, recording of a history information item in each of the first output-order file Fi1 and the first print-order file Fo1 is stopped. Then, recording of new history information items in a second output-order file Fi2 and a second print-order file Fo2 that are newly generated is performed.

Note that, as described above, in the present exemplary embodiment, when the print server 100 is activated, each of an output-order file and a print-order file is newly generated. Thus, for example, in the case of reactivation of the print server 100, history information items concerning output processes and print processes that have been performed before reactivation of the print server 100 is performed are written in files that have been provided as targets for recording of history information items before reactivation of the print server 100 is performed. However, history information items concerning output processes and print processes that are performed after reactivation of the print server 100 has been performed are written in other files that are newly generated after reactivation of the print server 100 has been performed.

More specifically, as illustrated in FIG. 8, for example, a case is assumed, in which reactivation of the print server 100 is performed after a print job K written in the two hundred second line of the second output-order file Fi2 has been performed and the print job K written in the two hundred second line of the second print-order file Fo2 has been performed.

In this case, the print job K is written in each of the second output-order file Fi2 and the second print-order file Fo2. Then, writing of history information items in the second output-order file Fi2 and the second print-order file Fo2 finishes.

After the print server 100 is reactivated, a third output-order file Fi3 and a third print-order file Fo3 that are new files are generated. A print job L is a history information item concerning an output process and a transmission process based on a print job that is newly accepted after reactivation of the print server 100 has been performed, and is written in the first line of each of the third output-order file Fi3 and the third print-order file Fo3 that are newly generated.

Moreover, the checking unit 140 adds, to multiple generated files, information items by which a chronological order in which the individual files have been generated is recognizable. As a scheme for adding information items by which a chronological order is recognizable, for example, a scheme in which information items concerning times at which files were generated are added to the individual files or a scheme in which the names of files that are chronologically ordered are added to the individual files may be used.

Operation of Checking Unit

The checking unit 140 compares the history information items recorded in the output-order list 111 and the history information items recorded in the print-order list 131, thereby checking whether an order in which the output processes for the print jobs have been performed and an order in which the transmission processes for the print jobs have been performed are the same. Checking of an order in which processes have been performed is performed by the checking unit 140 in units of print jobs. Accordingly, the orders of the processes in the individual lists (the output-order list 111 and the print-order list 131) may be compared with each other with respect to only either the start information items or the end information items among the history information items. In the present exemplary embodiment, the orders in which the individual processes (the output processes and the transmission processes) for the print jobs have been performed are checked using the start information items.

Furthermore, the checking unit 140 checks the print-order list 131 at appropriate time intervals (for example, every few seconds). When the number of data registered in the print-order list 131 has increased, compared with the number of data obtained when the checking unit 140 immediately previously checked the print-order list 131, the checking unit 140 performs a checking process. In this manner, in the case where no new transmission process has been performed, the checking process may be omitted. Whether the number of data registered in the print-order list 131 has increased may be determined by opening a data file of the print-order list 131 and checking the number of registered data, or simply on the basis of the file size of the print-order list 131.

Figure 9A:
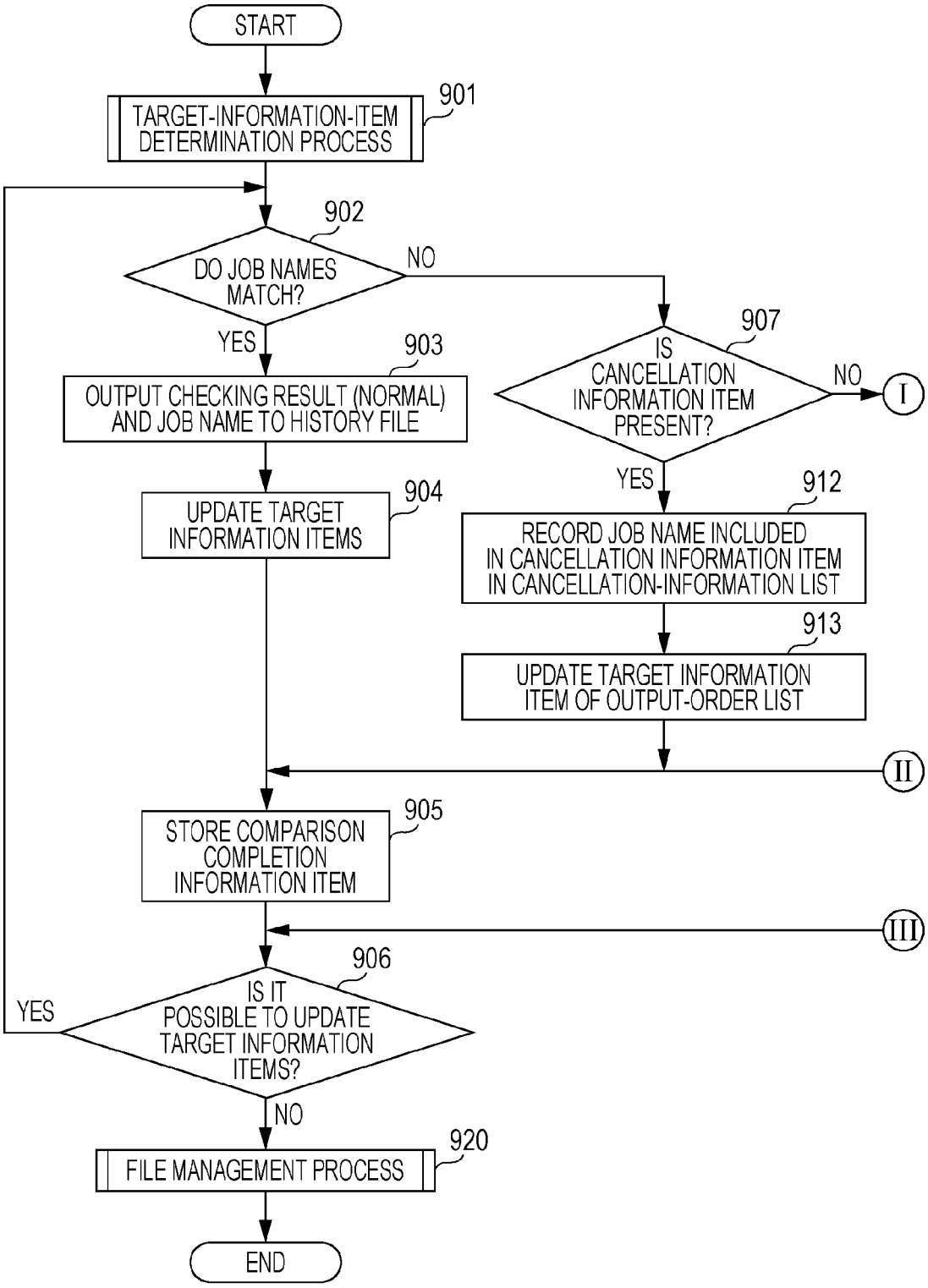
FIGS. 9A and 9B are a first part and a second part, respectively, of a flowchart illustrating the procedure of a checking process, which is performed by a checking unit, of checking a print order.
Figure 9B:
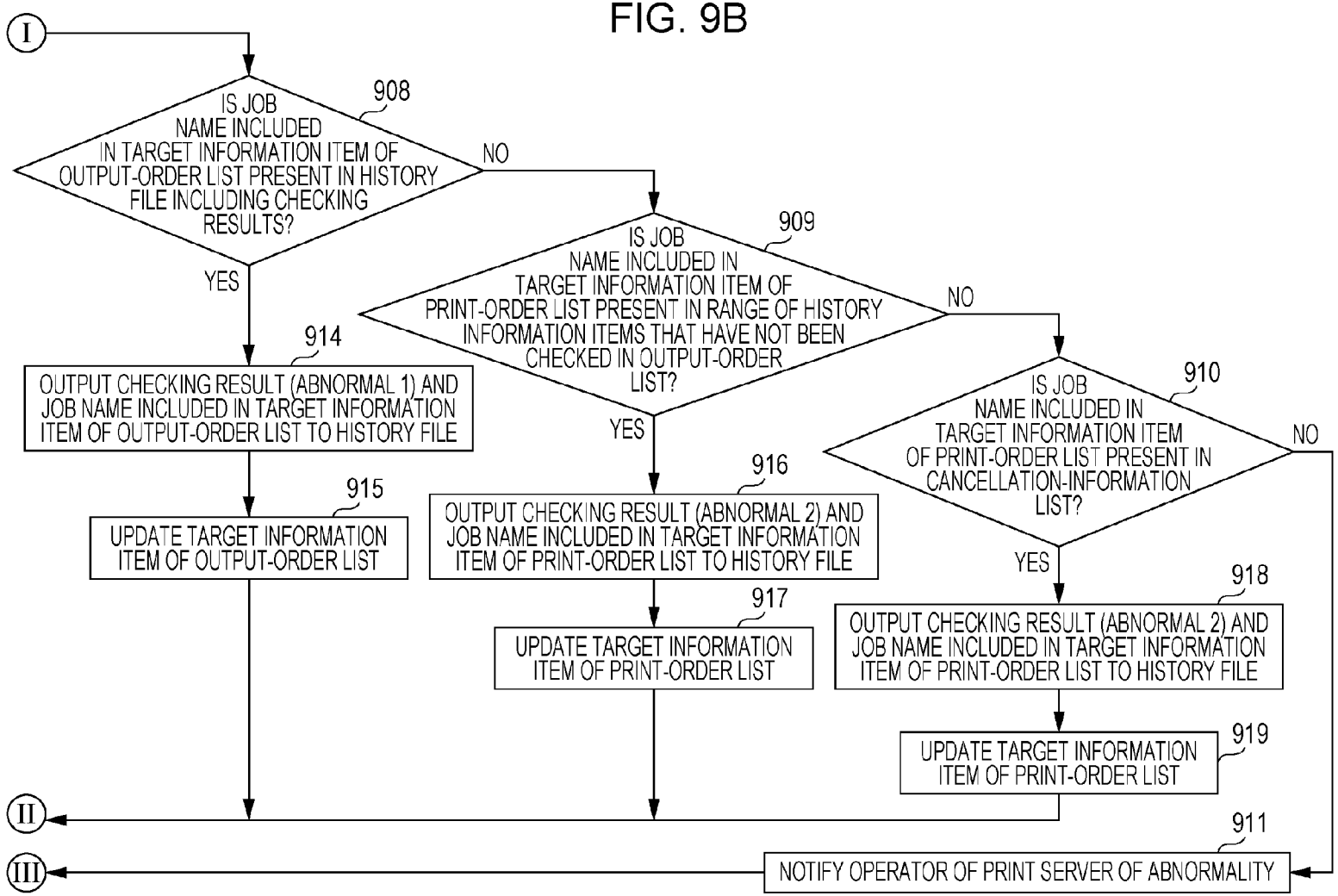

Furthermore, the checking unit 140 stores an information item (hereinafter, referred to as a "comparison completion information item") that is to be used to determine the last lines of lines that have been checked in the output-order list 111 and the print-order list 131. As illustrated in FIGS. 9A and 9B described below, storage of a comparison completion information item is performed after the target information item has been updated in each of the lists (the output-order list 111 and the print-order list 131) (see step 905 described below).

More specifically, when checking (comparison) of a history information item concerning a certain print job has finished, an information item concerning a "line number" of a line which is included in the list and in which the history information item that has been checked is written is stored. Furthermore, in the present exemplary embodiment, the output-order list 111 and the print-order list 131 are managed in units of files that are output-order files and print-order files, respectively. Accordingly, a comparison completion information item is stored as an information item indicating a file in which checking of a history information item has been completed. In other words, the checking unit 140 holds, as the comparison completion information item, an information item indicating a "file name" and a "line number".

Note that the checking unit 140 may generate an information item by which it is possible to determine, later, a file in which checking of a history information item has been completed. For example, a flag by which the fact that a history information item has been checked is recognizable is set in the history information item that has been checked, or, in contrast, an information item indicating that a history information item has not been checked may be generated.

FIGS. 9A and 9B are a first part and a second part, respectively, of a flowchart illustrating the procedure of the checking process, which is performed by the checking unit 140, of checking a print order.

First, the checking unit 140 performs a target-information determination process that is a process of determining history information items (hereinafter, referred to as "target information items") that are to be first used as checking targets (step 901). In the present exemplary embodiment, start information items that are history information items which have been determined by the target-information determination process are determined as the target information items. Note that the target-information determination process will be described below in detail.

Next, the checking unit 140 compares job names included in the determined target information items with each other (step 902).

In the case where the job names included in the compared target information items match (YES in step 902), this indicates that, regarding a print job specified by the target information items, the ordinal position of the transmission process for the print job in the order in which the transmission processes have been performed (i.e., the ordinal position of a print process for the print job in the order in which print processes have been performed by the image forming apparatus 200) and the ordinal position of the output process for the print job in the order in which the output processes have been performed (i.e., the ordinal position of a print instruction for the print job in the order in which print instructions have been accepted by the print server 100) are the same. Accordingly, because the ordinal position of the print instruction for the print job in the order in which the print instructions have been accepted and the ordinal position of a print process for the print job in the print order in which the print processes have been performed are not different from each other, the checking unit 140 outputs, to a history file, a checking result indicating that the ordinal position of the transmission process for the print job in the order in which the transmission processes have been performed (the ordinal position of the print process for the print job in the print order in which the print processes have been performed) is a normal position, and the job name included in the target information items (in step 903). The form of an information item recorded in the history file is not particularly limited, but at least an identification information item (here, the job name) of the print job and an information item indicating the details of the checking result (here, the information item indicating that the ordinal position of the transmission process for the print job in the order in which the transmission processes have been performed is a normal position) may be recorded. The history file including the checking result is held by a memory such as the memory 100*c* or the magnetic disk device 100*g* illustrated in FIG. 3, and this allows, for example, the operator of the image forming system to view the history file.

Next, the checking unit 140 updates the target information items to the next history information items (start information items) in the individual lists (step 904). Then, the checking unit 140 stores, as a comparison completion information item, an information item concerning the names of files (an output-order file and a print-order file) in which history information items that have been checked immediately before the target information items are updated are written and line numbers of lines in which the history information items that have been checked immediately before the target information items are updated are written (step 905). After that, the checking unit 140 determines whether or not history information items to which the target information items are to be updated are present, i.e., whether it is possible to update the target information items (step 906).

Then, when it is possible to update the target information items (NO in step 906), the checking unit 140 compares the updated target information items with each other (step 902). In the case where the history information items up to the last history information item in any one of the output-order list 111 and the print-order list 131 have been checked, because it is no longer possible to update the target information items (NO in step 906), the checking process finishes. Then, after checking has finished, the checking unit 140 performs a file management process of removing a file in which all history information items have been checked (step 920). Note that the file management process will be described below in detail.

In the case where the job names do not match when the target information items are compared with each other (NO in step 902), next, the checking unit 140 checks whether or not a cancellation information item concerning the job name included in the target information item of the output-order list 111 is present in the output-order list 111 (step 907).

In the case where the cancellation information item is present, execution of a print job having the print job name has been canceled. Thus, this mismatch between the job names does not indicate that an abnormality in the print order has occurred. Accordingly, the checking unit 140 does not output any checking result to the history file. However, in order to indicate that execution of the print job has been cancelled, the job name included in the cancellation information item is recorded in a cancellation-information list (step 912). Then, the checking unit 140 updates only the target information item of the output-order list 111 to the next history information item (start information item), and stores a comparison completion information item (steps 913, 905, and 906). After that, the checking unit 140 compares the target information item of the output-order list 111 with the target information item of the print-order list 131 (step 902).

In the case where the job names do not match (NO in step 902) when the target information items are compared with each other and where no cancellation information item concerning the job name included in the target information item of the output-order list 111 is present (NO in step 907), next, the checking unit 140 checks whether or not the job name included in the target information item of the output-order list 111 is present in the history file including checking results that have been obtained so far (step 908).

In the case where the job name included in the target information item is present in the history file including checking results, this indicates that a print job having the job name has already been executed, and an abnormality in the print order has occurred. Furthermore, the ordinal position of the target information item in the order in which the output processes have been performed in the output-order list 111 is the ordinal position at which the transmission process for the print job having the job name should have been performed in the order in which the transmission processes have been performed. Accordingly, the checking unit 140 outputs, to the history file, a checking result (abnormal 1) indicating that the ordinal position at which the transmission process for the print job should have been performed in the order in which the transmission processes have been performed and the job name included in the target information item of the output-order list 111 (step 914). Then, the checking unit 140 updates only the target information item of the output-order list 111 to the next history information item (start information item), and stores a comparison completion information item (steps 915, 905, and 906). After that, the checking unit 140 compares the target information item of the output-order list 111 with the target information item of the print-order list 131 (step 902).

In the case where the job names do not match when the target information items are compared with each other (NO in step 902), where no cancellation information item concerning the job name included in the target information item of the output-order list 111 is present (NO in step 907), and where the job name included in the target information item of the output-order list 111 is not present in the history file including checking results that have been obtained so far (NO in step 908), next, the checking unit 140 checks whether or not the job name included in the target information item of the print-order list 131 is present in the range of the history information items that have not been checked in the output-order list 111 (step 909).

In the case where the job name included in the target information item of the print-order list 131 is present in the range of the history information items that have not been checked in the output-order list 111, this indicates that the ordinal position at which the transmission process for a print job having the job name should have been performed in the order in which the transmission processes have been performed is later than the current ordinal position, and that an abnormality in the print order has occurred. Accordingly, the checking unit 140 outputs, to the history file, a checking result (abnormal 2) indicating that the transmission process for the print job has been performed at an ordinal position earlier than the ordinal position at which the transmission process for the print job should have been performed in the order in which the transmission processes have been performed, and the job name included in the target information item of the print-order list 131 (step 916). Then, the checking unit 140 updates only the target information item of the print-order list 131 to the next history information item (start information item), and stores a comparison completion information item (steps 917, 905, and 906). After that, the checking unit 140 compares the target information item of the print-order list 131 with the target information item of the output-order list 111 (step 902).

In the case where the job names do not match when the target information items are compared with each other (NO in step 902), where no cancellation information item concerning the job name included in the target information item of the output-order list 111 is present (NO in step 907), where the job name included in the target information item of the output-order list 111 is not present in the history file including checking results that have been obtained so far (NO in step 908), and where the job name included in the target information item of the print-order list 131 is not present in the range of the history information items that have not been checked in the output-order list 111 (NO in step 909), next, the checking unit 140 checks whether or not the job name included in the target information item of the print-order list 131 is present in the cancellation-information list (step 910).

In the case where the job name included in the target information item is present in the cancellation-information list, this indicates that, although a cancellation instruction for a print job having the job name that has been provided, the transmission process for the print job has been performed before print data is removed from the storage unit 120. Then, the print job has been executed, whereby a print process for the print job has been performed at an ordinal position, in the order in which the print processes have been performed, different from an ordinal position at which a print instruction for the print job has been provided in the order in which the print instructions have been provided. Thus, an abnormality in the print order has occurred. Accordingly, the checking unit 140 outputs, to the history file, a checking result (abnormal 2) indicating that the transmission process for the print job has been performed at an ordinal position earlier than the ordinal position at which the transmission process for the print job should have been performed in the order in which the transmission processes have been performed, and the job name included in the target information item of the print-order list 131 (step 918). Then, the checking unit 140 updates only the target information item of the print-order list 131 to the next history information item (start information item), and stores a comparison completion information item (steps 919, 905, and 906). After that, the checking unit 140 compares the target information item of the print-order list 131 with the target information item of the output-order list 111 (step 902).

In the case where the job names do not match when the target information items are compared with each other (NO in step 902), where no cancellation information item concerning the job name included in the target information item of the output-order list 111 is present (NO in step 907), where the job name included in the target information item of the output-order list 111 is not present in the history file including checking results that have been obtained so far (NO in step 908), where the job name included in the target information item of the print-order list 131 is not present in the range of the history information items that have not been checked in the output-order list 111 (NO in step 909), and where the job name included in the target information item of the print-order list 131 is not present in the cancellation-information list (NO in step 910), there is a high probability that an abnormality different from a simple change in the print order has occurred. The checking unit 140 notifies the operator of the print server 100 that an abnormality has occurred (step 911). Notification of occurrence of an abnormality is performed by, for example, displaying an error message using the display mechanism 100*d* illustrated in FIG. 3, or by outputting a warning sound using the sound mechanism 100*h* illustrated in FIG. 3. Moreover, in the case where there is a high probability that the abnormality severely affects the image forming system, control may be performed so that execution of the print job will be forcibly stopped.

In the present exemplary embodiment, as described above, it is assumed that there are four types of cases (see steps 907 to 910 illustrated in FIGS. 9A and 9B) as cases where the output-order list 111 and the print-order list 131 do not match. Among the cases, in the cases other than the case where execution of a print job has been cancelled (see step 907), print jobs have been executed in an incorrect order. Accordingly, the checking unit 140 performs an error process of notifying, for example, the operator of the print server 100 that an abnormality in the print order has occurred. In the above-described example, as the error process, the checking unit 140 performs a process of recording an information item indicating that an abnormality in the print order has occurred in the history file which includes checking results and which is viewable by, for example, the operator of the print server 100. Alternatively, as in the case of notification of an abnormality in step 911, the checking unit 140 may perform, for example, display of an error message using the display mechanism 100*d* or output of a warning sound using the sound mechanism 100*h*.

The checking unit 140 may perform different error processes for the types of cases where an error process is performed. For example, in the case where the transmission process for the print job has been performed at an ordinal position earlier than the ordinal position at which the transmission process for the print job should have been performed in the order the transmission processes have been performed (see step 909), display of an error message or output of a warning sound may be performed. In the other cases, without performing display of an error message or output of a warning sound, only recording of an information item in the history file may be performed. Regarding which error process is to be applied to each of the cases, a selection of an error process made by, for example, a user of the image forming system according to the present exemplary embodiment may be accepted, and the selected error process may be set.

Note that, in the above-described example of the operation of the checking unit 140, in the case where a cancellation information item concerning the job name included in the target information item of the output-order list 111 is present in step 907, the job name included in the cancellation information item is recorded in the cancellation-information list (see step 912). Then, in step 910, whether or not the job name included in the target information item of the print-order list 131 is present in the cancellation-information list is checked, whereby whether or not a cancellation instruction for the print job has been provided is determined. Here, without generating the cancellation-information list, instated of checking the cancellation-information list in step 910, whether or not a cancellation information item is present in the range of the history information items that have not been checked in the output-order list 111 may be checked. However, every time determination of whether or not a cancellation information item is present is performed, the output-order list 111 in which a large number of history information items are recorded is searched for a cancellation information item in order from the history information item included in the top row. This leads to much duplication in processing, and, consequently, the processing efficiency is low. Furthermore, because the storage capacity of a memory that the print server 100 has is limited, regarding the output-order list 111 and the print-order list 131, data registered therein are removed in units of files on the basis of a predetermined condition which is described below.

For this reason, separately from the output-order list 111, a cancellation-information list is generated, and, in step 910, this cancellation-information list is searched for the job name. This achieves an improvement in the processing efficiency, and makes possible to search for a cancellation information item even when the cancellation information item is removed from the output-order list 111. Furthermore, the cancellation-information list is held and viewable by, for example, the operator of the print server 100. Thus, this makes possible for, for example, the operator to check that a cancellation instruction for a print job has been provided.

Next, the target-information determination process, which is performed in step 901, and the file management process, which is performed in step 902, will be described in detail.

Figure 10:
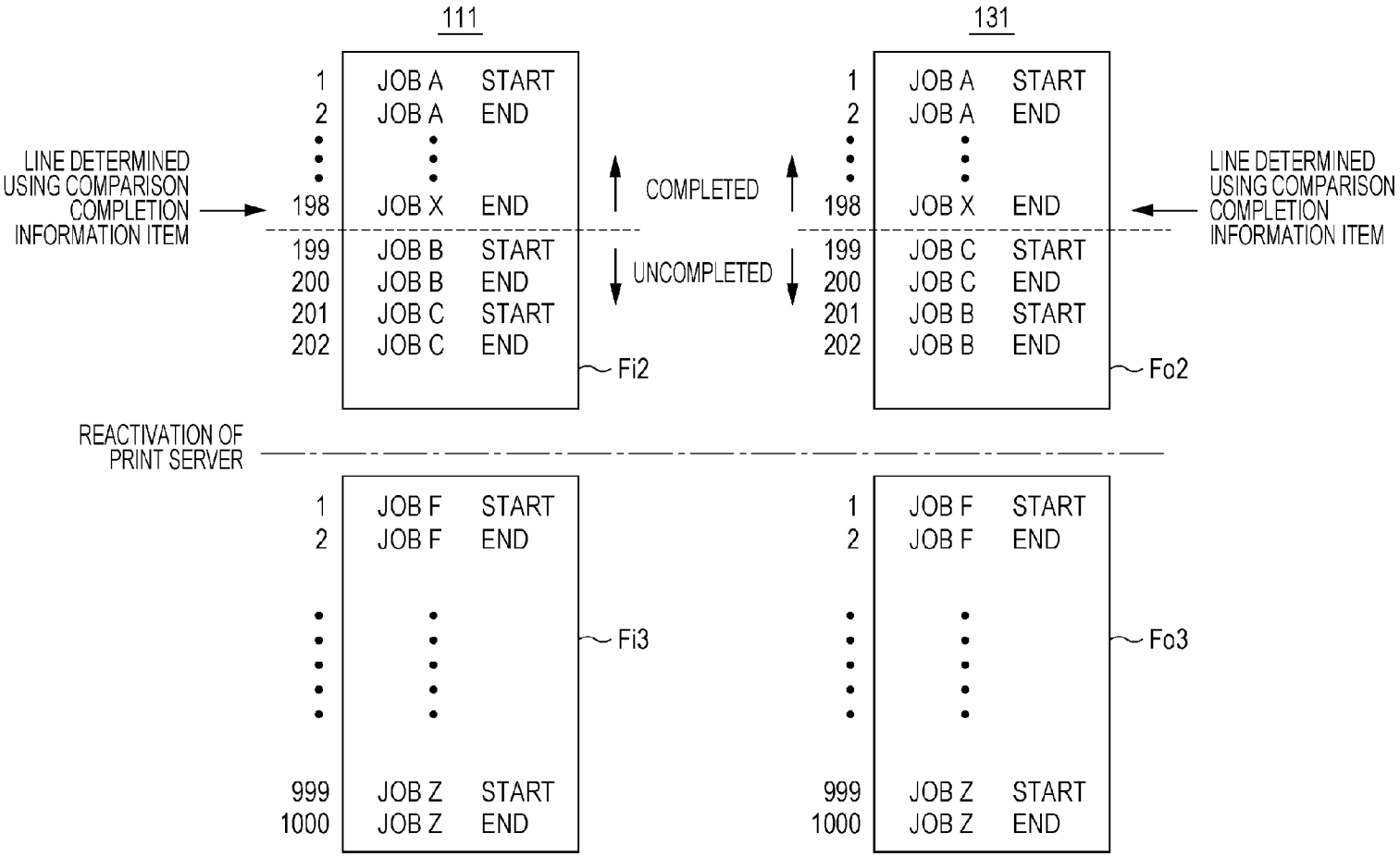
FIG. 10 illustrates a specific example of a file configuration for explaining a target-information determination process and a file management process.

FIG. 10 illustrates a specific example of a file configuration for explaining the target-information determination process and the file management process.

Figure 11:
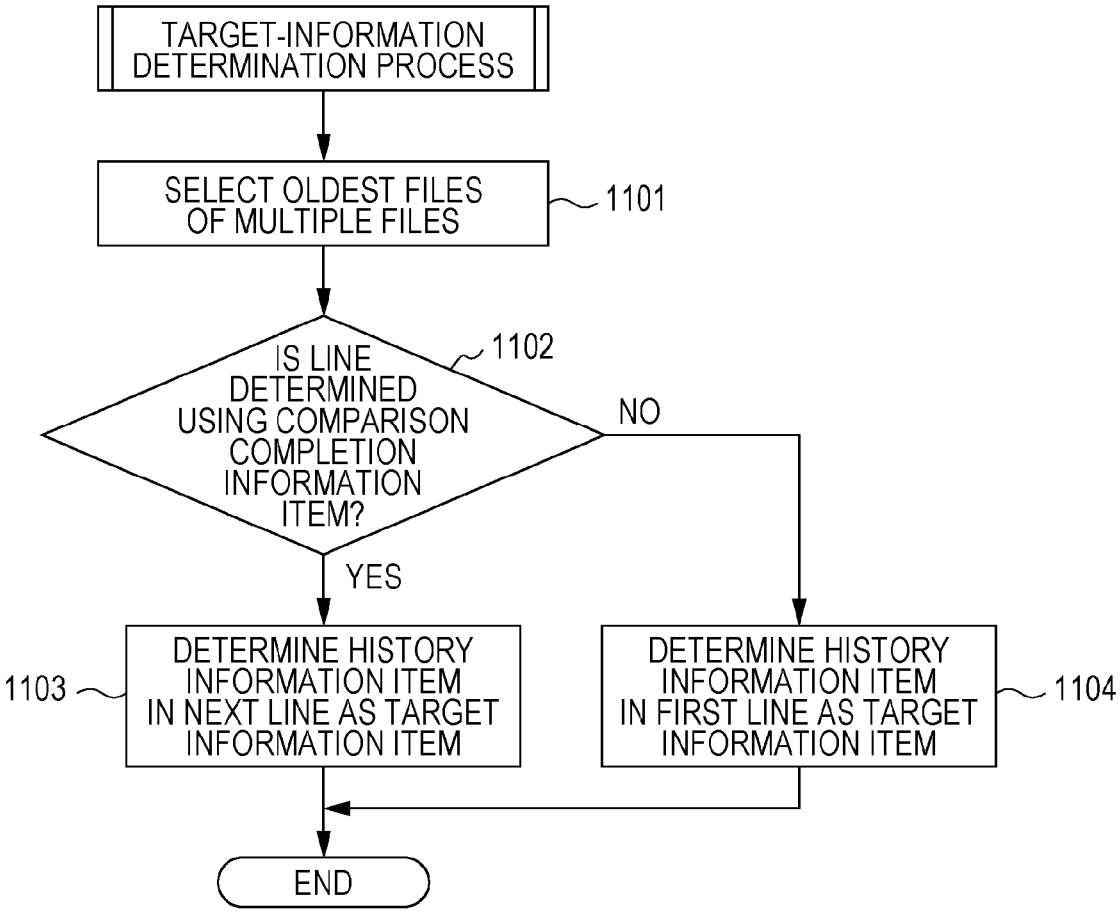
FIG. 11 is a flowchart illustrating the procedure of the target-information determination process.

FIG. 11 is a flowchart illustrating the procedure of the target-information determination process.

Figure 12:
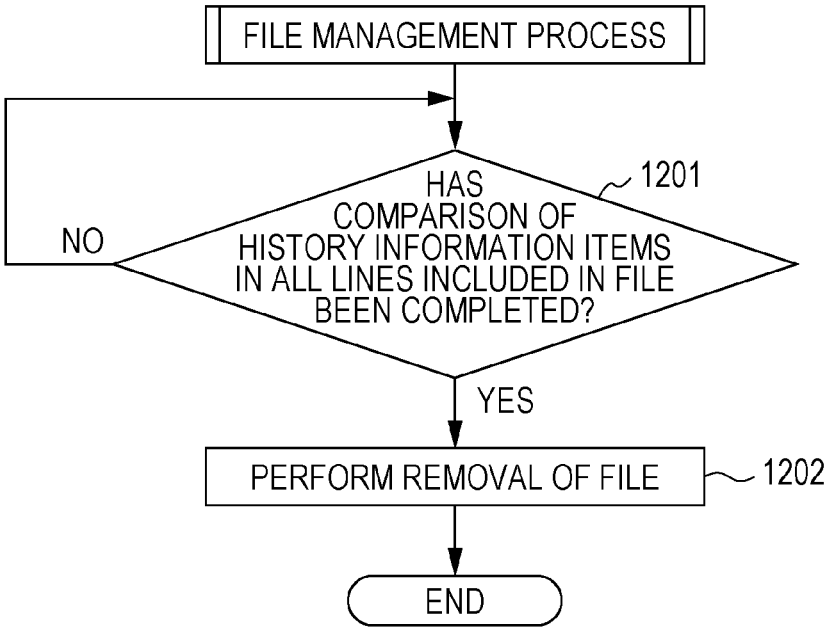
FIG. 12 is a flowchart illustrating the procedure of the file management process.

FIG. 12 is a flowchart illustrating the procedure of the file management process.

In FIG. 10, the second output-order file Fi2, the second print-order file Fo2, the third output-order file Fi3, and the third print-order file Fo3 are illustrated. Here, in the example illustrated in FIG. 10, the second output-order file Fi2 and the second print-order file Fo2 are files in the case where, when the print server 100 was activated the last time, the print server 100 was shut down in the middle of performing the checking process for the files and where checking of the entire files was not completed. In the example illustrated in FIG. 10, checking of print jobs up to a print job X in the one hundred ninety eight line, which has a line number of 198, has been performed, and it is determined using a comparison completion information item that comparison of the print jobs up to the print job X in the one hundred ninety eight line has been completed. Furthermore, the third output-order file Fi3 and the third print-order file Fo3 are files that are newly generated after the print server 100 has been reactivated.

First, the target-information determination process will be described.

As illustrated in FIG. 11, in the target-information determination process, first, the oldest files (an output-order file and a print-order file) are searched for (step 1101).

In the example illustrated in FIG. 10, for example, the second output-order file Fi2 and the second print-order file Fo2 are selected as the oldest files. Note that, when only one file (only one output-order file and only one print-order file) is present, the one file is considered as the oldest file.

Whether or not a line (a history information item) of each of the oldest files that have been searched for in step 1101 is determined using a comparison completion information item is determined (step 1102).

Then, when a line of the file is determined using a comparison completion information item (YES in step 1102), a history information item in the line next to the line determined using the comparison completion information item is determined as the target information item (step 1103). Then, as described with reference to step 902 of FIG. 9A, comparison of job names included in the target information items that have been determined by the target-information determination process is performed.

In the example illustrated in FIG. 10, using a comparison completion information item, it is determined that comparison of print jobs up to the print job X in the one hundred ninety eighth line of the second output-order file Fi2 has been completed and comparison of print jobs up to the print job X in the one hundred ninety eighth line of the second print-order file Fo2 has been completed. Accordingly, the checking process is performed for history information items in the one hundred ninety ninth line and lines thereafter (a print job B and print jobs thereafter) of the second output-order file Fi2 and history information items in the one hundred ninety ninth line and lines thereafter (a print job C and print jobs thereafter) of the second print-order file Fo2.

Note that, in the example illustrated in FIG. 10, in the checking process that is performed after the print server 100 is reactivated, it is detected that the order of the print jobs B and C in the second output-order file Fi2 and the order of the print jobs C and B in the second print-order file Fo2, which are orders in which the print job B and the print job C have been performed, are different from each other.

Then, after checking of history information items in the second output-order file Fi2 and the second print-order file Fo2 has been completed, the checking process is performed for a print job F in the first line of the third output-order file Fi3 and the print job F in the first line of the third print-order file Fo3.

In contrast, when no line of any one of the files is determined using a comparison completion information item (NO in step 1102), a history information item in the first line of the file is determined as the target information item (step 1104). Then, as described with reference to step 902 of FIG. 9A, comparison of job names included in the target information items that have been determined by the target-information determination process is performed.

Note that this case is, for example, a case where the checking process for all history information items has already been completed when the print server 100 has operated previously, where the print server 100 is normally shut down, and where, after that, activation of the print server 100 is performed.

Next, the file management process will be described in detail.

In the case where whether it is possible to update a file is determined in the checking process and where, consequently, no file is updated, whether or not comparison of history information items in all lines included in the file that is a target has been completed is determined (step 1201).

Note that, in the case where start information items among history information items are used as the target information items in comparison as in the present exemplary embodiment, the process proceeds under the assumption that comparison for lines in which history information items that are end information items corresponding to the start information items are written has been completed.

Then, when comparison of history information items in all lines included in the file has been completed (YES in step 1201), removal of the file is performed (step 1202).

In contrast, when comparison of history information items in all lines included in the file has not been completed (NO in step 1201), in step 1201, whether or not comparison of history information items in all lines included in the file that is a target has been completed is determined again.

Note that, in the example illustrated in FIG. 10, comparison of history information items in all lines of the second output-order file Fi2 and the second print-order file Fo2 has been completed, and, consequently, the second output-order file Fi2 and the second print-order file Fo2 are individually removed.

Furthermore, as a result of removal of the second output-order file Fi2 and the second print-order file Fo2, the oldest files that are targets for searching in the target-information determination process are the third output-order file Fi3 and the third print-order file Fo3.

As described above, in the present exemplary embodiment, in the target-information determination process, checking of history information items is performed on the basis of the orders in which files have been generated and a comparison completion information item. Checking of history information items is performed for the oldest files, and is performed, on the basis of the comparison completion information item, for history information items that have not been compared. Accordingly, for example, even in the case where the print server 100 is shut down for a certain reason and where, then, the print server 100 is reactivated, after the print server 100 is reactivated, it is possible to distinguish history information items that have already been checked and history information items that have not been checked from each other. As a result, in the print server 100 according to the present exemplary embodiment, it is possible to completely detect an abnormality in the print order.

Furthermore, because checking of history information items is performed on the basis of the comparison completion information item, it is possible to skip lines in which history information items that have already been compared are written, and to perform checking of history information items in such a manner that the checking starts from a history information item which has not been compared. Thus, it is possible to efficiently check history information items, for example, compared with that in a case where history information items are sequentially compared in order simply from a history information item in the first line of a file. Moreover, it is possible to prevent a situation in which an error process that has already been performed is performed redundantly because, for example, an abnormality in the order in which processes have been performed has already been detected before the print server 100 is reactivated and the abnormality is detected again after the print server 100 is reactivated.

Moreover, lines are searched, for an incorrect print order, in chronological order from the oldest line (a line having the smallest line number) to the newest line (a line having the largest line number), thereby making it possible to promptly detect an abnormality in the print order that has occurred at an earlier time and to notify the user of an error. Typically, in the case of searching the print order of print media that have been practically printed for an incorrect portion of the print order, recognition of the first incorrect portion of the print order makes the search task easier. Thus, there is a request to recognize the first abnormal portion of the print order first. Therefore, an abnormality in the print order that has occurred at an earlier time may be promptly detected, and the user may be notified of an error.

More particularly, for example, in the case where the print server 100 is reactivated in a situation in which the print server 100 has needed to be shut down, it is assumed that a heavy load has been imposed on processing of the print server 100. In such a case, it is considered that there is a high probability that a phenomenon in which the order in which output processes have been performed and the order in which transmission processes have been performed are different from each other has frequently occurred before the print server 100 is reactivated. Thus, in the case of detecting, in chronological order from the newest line to the oldest line, an abnormality in the order in which processes have been performed, it takes a certain time to detect the first abnormal portion of the print order. For this reason, in the checking process in the present exemplary embodiment, a configuration is used, in which comparison in chronological order from the oldest line to the newest line is performed.

Additionally, removal of a file including history information items that have been checked is performed by the file management process, whereby an opportunity to regularly remove a certain number of history information items is provided, and it is possible to efficiently perform detection of an abnormality in the order in which processes have been performed. Furthermore, removal of a file including history information items that have been checked is performed by the file management process, whereby effective utilization of a limited storage area of a memory is also realized.

Note that, in the present exemplary embodiment, for example, as illustrated in FIGS. 7A and 7B, regarding the output processes, after reception of one print job with the storage unit 120 of the print server 100 has been completed, transmission of the next print job to the storage unit 120 starts. However, the present invention is not limited thereto.

For example, a configuration may be used, in which multiple print jobs are collectively output to the storage unit 120. In other words, regarding the output processes, the output processes may be performed so that, before reception of one print job with the storage unit 120 is completed, transmission of another print job to the storage unit 120 starts. However, in this case, regarding the transmission process of transmitting print data from the storage unit 120 to the image forming apparatus 200, a phenomenon in which the order in which the above-mentioned output processes have been performed and the order in which the transmission processes have been performed are different from each other easily occurs.

However, in the system according to the present exemplary embodiment, a configuration is used, in which an error process is performed in the case where the order in which the output processes have been performed and the order in which the transmission processes have been performed are different from each other. Thus, it is possible to perform a process such as a process of notifying the user of an abnormality in the print order of print medium. Therefore, it is possible to provide a particularly effective system in an image forming system that employs the output processes.

While the present exemplary embodiment has been described, the technical scope of the present invention is not limited to the scope described in the foregoing exemplary embodiment. It is clear from the descriptions in the claims that a variety of modifications and improvements may be made to the foregoing exemplary embodiment and such modifications and improvements may also fall within the technical scope of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A control apparatus comprising:

an output unit that acquires image formation information items which are to be used in image formation by an image forming unit which forms images, and that performs output processes of outputting the image formation information items in order to cause a storage unit that temporarily stores the image formation information items to store the image formation information items;

a transmission unit that acquires the image formation information items from the storage unit, and that performs transmission processes of transmitting the image formation information items to the image forming unit;

an output-history generating unit that generates output histories in which an order in which unit processes constituting the output processes have been performed is recorded;

a transmission-history generating unit that generates transmission histories in which an order in which unit processes constituting the transmission processes have been performed is recorded;

a checking unit that checks whether or not the order in which the unit processes have been performed, which is recorded in the output histories, and the order in which the unit processes have been performed, which is recorded in the transmission histories, match; and a determination-information generating unit that generates a determination information item which is to be used in determination of a unit process, among the unit processes, that has been checked by the checking unit in the output histories and a unit process, among the unit processes, that has been checked by the checking unit in the transmission histories, wherein the image formation information items comprises print instructions, wherein the output-history generating unit generates the output histories in the order of the stored image formation information items, and wherein the output histories are generated before the transmission processes have been performed.

2. The control apparatus according to claim 1, further comprising a file generating unit that individually generates output-history files in which the plurality of output histories are recorded in units based on a predetermined condition and transmission-history files in which the plurality of transmission histories are recorded in units based on the predetermined condition, wherein the checking unit checks the output histories and the transmission histories in preferential order from the output histories and the transmission histories recorded in oldest files of the output-history files and the transmission-history files that have been generated.

3. The control apparatus according to claim 2, further comprising a removal unit that removes a file in which checking of all of the unit processes has been completed by the checking unit among the output-history files and the transmission-history files generated by the file generating unit.

4. The control apparatus according to claim 1, wherein the transmission-history generating unit generates the transmission histories based on the order of transmitting the image formation information items to the image forming unit.

5. An image forming system comprising:

an image forming unit that forms images;

an output unit that acquires image formation information items which are to be used in image formation by the image forming unit, and that performs output processes of outputting the image formation information items in order to cause a storage unit that temporarily stores the image formation information items to store the image formation information items;

a transmission unit that acquires the image formation information items from the storage unit, and that performs transmission processes of transmitting the image formation information items to the image forming unit;

an output-history generating unit that generates output histories in which an order in which unit processes constituting the output processes have been performed is recorded;

a transmission-history generating unit that generates transmission histories in which an order in which unit processes constituting the transmission processes have been performed is recorded;

a checking unit that checks whether or not the order in which the unit processes have been performed, which is recorded in the output histories, and the order in which the unit processes have been performed, which is recorded in the transmission histories, match; and a determination-information generating unit that generates a determination information item which is to be used in determination of a unit process, among the unit processes, that has been checked by the checking unit in the output histories and a unit process, among the unit processes, that has been checked by the checking unit in the transmission histories, wherein the image formation information items comprises print instructions, wherein the output-history generating unit generates the output histories in the order of the stored image formation information items, and wherein the output histories are generated before the transmission processes have been performed.

6. A non-transitory computer-readable medium storing a program causing a computer to execute a process, the process comprising:

acquiring image formation information items which are to be used in image formation by an image forming unit that forms images, and performing output processes of outputting the image formation information items in order to cause a storage unit that temporarily stores the image formation information items to store the image formation information items;

acquiring the image formation information items from the storage unit, and performing transmission processes of transmitting the image formation information items to the image forming unit;

generating output histories in which an order in which unit processes constituting the output processes have been performed is recorded;

generating transmission histories in which an order in which unit processes constituting the transmission processes have been performed is recorded;

checking whether or not the order in which the unit processes have been performed, which is recorded in the output histories, and the order in which the unit processes have been performed, which is recorded in the transmission histories, match; and generating a determination information item which is to be used in determination of a unit process, among the unit processes, that has been checked in the output histories and a unit process, among the unit processes, that has been checked in the transmission histories, wherein the image formation information items comprises print instructions, wherein the generating the output histories comprises generating the output histories in the order of the stored image formation information items, and wherein the output histories are generated before the transmission processes have been performed.

7. A control apparatus comprising:

an output unit that acquires image formation information items which are to be used in image formation by an image forming unit which forms images, and that performs output processes of outputting the image formation information items in order to cause a storage unit that temporarily stores the image formation information items to store the image formation information items;

a transmission unit that acquires the image formation information items from the storage unit, and that performs transmission processes of transmitting the image formation information items to the image forming unit;

an output-history generating unit that generates output histories in which an order in which unit processes constituting the output processes have been performed is recorded;

a transmission-history generating unit that generates transmission histories in which an order in which unit processes constituting the transmission processes have been performed is recorded;

a checking unit that checks whether or not the order in which the unit processes have been performed, which is recorded in the output histories, and the order in which the unit processes have been performed, which is recorded in the transmission histories, match; and a determination-information generating unit that generates a determination information item which is to be used in determination of a unit process, among the unit processes, that has been checked by the checking unit in the output histories and a unit process, among the unit processes, that has been checked by the checking unit in the transmission histories, wherein the checking unit checks the unit processes in order from a unit process whose ordinal position follows the ordinal position of the unit process determined using the determination information item in the order in which the unit processes have been performed.

8. The control apparatus according to claim 7, further comprising a file generating unit that individually generates output-history files in which the plurality of output histories are recorded in units based on a predetermined condition and transmission-history files in which the plurality of transmission histories are recorded in units based on the predetermined condition, wherein the checking unit checks the output histories and the transmission histories in preferential order from the output histories and the transmission histories recorded in oldest files of the output-history files and the transmission-history files that have been generated.

9. The control apparatus according to claim 8, further comprising a removal unit that removes a file in which checking of all of the unit processes has been completed by the checking unit among the output-history files and the transmission-history files generated by the file generating unit.

* * * * *